US006065416A

United States Patent [19]

Araeen

[11] Patent Number: 6,065,416

[45] Date of Patent: May 23, 2000

[54] WIND PROPELLED WATERCRAFT

[76] Inventor: Rasheed Araeen, 120 Greencroft Gardens, London, England NW6 3PJ, United Kingdom

[21] Appl. No.: 09/282,720

[22] Filed: Mar. 31, 1999

Related U.S. Application Data

[63] Continuation-in-part of application No. 09/105,443, Jun. 26, 1998, abandoned.

[51] Int. Cl.[7] ..... B63H 9/04

[52] U.S. Cl. ..... 114/102.11; 440/37; 114/39.1; 114/39.2; 441/74

[58] Field of Search ..... 114/39.1, 39.2, 114/102.11; 441/65, 67, 74, 75; 440/37; 280/810

[56] References Cited

U.S. PATENT DOCUMENTS

| | | |
|---|---|---|
| D. 310,596 | 9/1990 | Burger . |
| 1,110,710 | 9/1914 | Ogilvie . |
| 1,178,165 | 4/1916 | Lupton, Jr. . |
| 2,577,917 | 12/1951 | Root . |
| 3,085,254 | 4/1963 | Cutler . |
| 3,742,886 | 7/1973 | Dillon . |
| 4,220,299 | 9/1980 | Motter . |
| 4,269,133 | 5/1981 | Brown . |
| 4,669,407 | 6/1987 | Cobb . |
| 4,708,076 | 11/1987 | Lekhtman . |
| 5,366,182 | 11/1994 | Roeseler et al. . |

FOREIGN PATENT DOCUMENTS

| | | |
|---|---|---|
| 29 25 378 | 6/1979 | Canada . |
| 1325647 | 12/1993 | Germany . |

*Primary Examiner*—Jesus D. Sotelo

[57] ABSTRACT

A wind propelled watercraft system is provided including a floating disk for supporting a user on a body of water. Also included is a sail assembly for driving the user on the floating disk by way of wind. The floating disk has an inwardly-facing groove for receiving the user's toes and is provided with a generally part-spherical bottom face. The sails extend between the arms and the body of the user, whereby the user can spill wind by lowering the arms.

16 Claims, 4 Drawing Sheets

WIND PROPELLED WATERCRAFT

CROSS-REFERENCE TO RELATED APPLICATION

This application is a Continuation-in-Part of my U.S. patent application Ser. No. 09/105,443 filed Jun. 26, 1998, now abandoned.

BACKGROUND OF THE INVENTION

1. Field of the Invention

The present invention relates to wind propelled watercraft, sometimes termed kiteskis, and more particularly pertains to a new wind propelled watercraft system for driving a user aboard a float on a body of water by way of a sail assembly worn by the user.

2. Description of the Prior Art

The use of kiteskis is known in the prior art. More specifically, kiteskis heretofore devised and utilized are known to consist basically of familiar, expected and obvious structural configurations, notwithstanding the myriad of designs encompassed by the crowded prior art which have been developed for the fulfillment of countless objectives and requirements.

Known prior art kiteskis or similar devices include U.S. Pat. No. 5,366,182; U.S. Pat. No. 4,708,076; U.S. Pat. No. 4,220,299; U.S. Pat. No. 4,669,407; U.S. Pat. Des. 310,596; U.S. Pat. No. 3,085,254; U.S. Pat. No. 1,110,710; Canadian Patent No. 1,325,647 and German Patent Application No. 2925378.

In these respects, the wind propelled watercraft according to the present invention substantially departs from the conventional concepts and designs of the prior art, and in so doing provides an apparatus primarily developed for the purpose of driving a user aboard a float on a body of water by way of a sail assembly worn by the user.

SUMMARY OF THE INVENTION

In view of the foregoing disadvantages inherent in the known types of kiteskis now present in the prior art, the present invention provides a new wind propelled watercraft construction wherein the same can be utilized for driving a user aboard a float on a body of water by way of a sail assembly worn by the user.

The general purpose of the present invention, which will be described subsequently in greater detail, is to provide a new wind propelled watercraft apparatus and method which has many of the advantages of the kiteskis mentioned heretofore and many novel features that result in a new wind propelled watercraft which is not anticipated, rendered obvious, suggested, or even implied by any of the prior art kiteskis, either alone or in any combination thereof.

To attain this, the present invention in one embodiment generally comprises a floating disk having a bottom face with a generally part-spherical or at least generally continuously curved configuration. A top face of the floating disk is equipped with a generally planar circular configuration. The top face and bottom face of the base may be coupled along a periphery thereof for defining a hollow interior. The top face of the base has a recess formed in concentric relationship therewith. The recess includes a bottom plate with a planar circular configuration and having an upper roughened surface. The top face further has an annular flange integrally coupled to an upper peripheral edge of the recess. Such annular flange extends radially inwardly from the upper peripheral edge of the recess in coplanar relationship with the top face of the disk. The annular flange is spaced from the bottom plate of the recess thereby defining an annular groove.

Next provided is a sail assembly including a waist strap. A pair of vertically oriented parallel shoulder straps each have a bottom end coupled to the waist strap. A torso strap is coupled to upper portions of the shoulder straps in parallel with the waist strap. A pair of wrist straps are also included. The sail assembly further includes a pair of sails each having a generally triangular configuration. Each sail is equipped with a linear top edge having an outboard end coupled to one of the wrist straps. A linear inner edge of each sail has a top end coupled to the torso strap and a central portion coupled to the waist strap.

There has thus been outlined, rather broadly, the more important features of an embodiment of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining two embodiments of the invention in detail, it is to be understood that the invention is not limited in its application to the details of construction and to the arrangements of the components set forth in the following description or illustrated in the drawings. The invention is capable of other embodiments and of being practised and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wind propelled watercraft apparatus and method which has many of the advantages of the kiteskis mentioned heretofore and many novel features that result in a new wind propelled watercraft which is not anticipated, rendered obvious, suggested, or even implied by any of the prior art kiteskis, either alone or in any combination thereof.

It is another object of the present invention to provide a new wind propelled watercraft which may be easily and efficiently manufactured and marketed.

It is a further object of the present invention to provide a new wind propelled watercraft which is of a durable and reliable construction.

An even further object of the present invention is to provide a new wind propelled watercraft which is susceptible of a low cost of manufacture with regard to both materials and labour, and which accordingly is then susceptible of low prices of sale to the consuming public, thereby making such wind propelled watercraft economically available to the buying public.

Still yet another object of the present invention is to provide a new wind propelled watercraft which provides in the apparatuses and methods of the prior art some of the advantages thereof, while simultaneously overcoming some of the disadvantages normally associated therewith.

Still another object of the present invention is to provide a new wind propelled watercraft for driving a user aboard a float on a body of water by way of a sail assembly worn by the user.

Even still another object of the present invention is to provide a new wind propelled watercraft that includes a floating disk for supporting a user on a body of water. Also included is a sail assembly for driving the user on the floating disk by way of wind.

A further object is to provide a wind propelled watercraft which possesses the characteristics of balance and flexibility and is stable at a range of angular positions.

Yet another object of the invention is to provide a wind powered watercraft which is easy to manage in a variety of wind conditions and which is relatively safe to use and in which the sails are easy to manipulate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
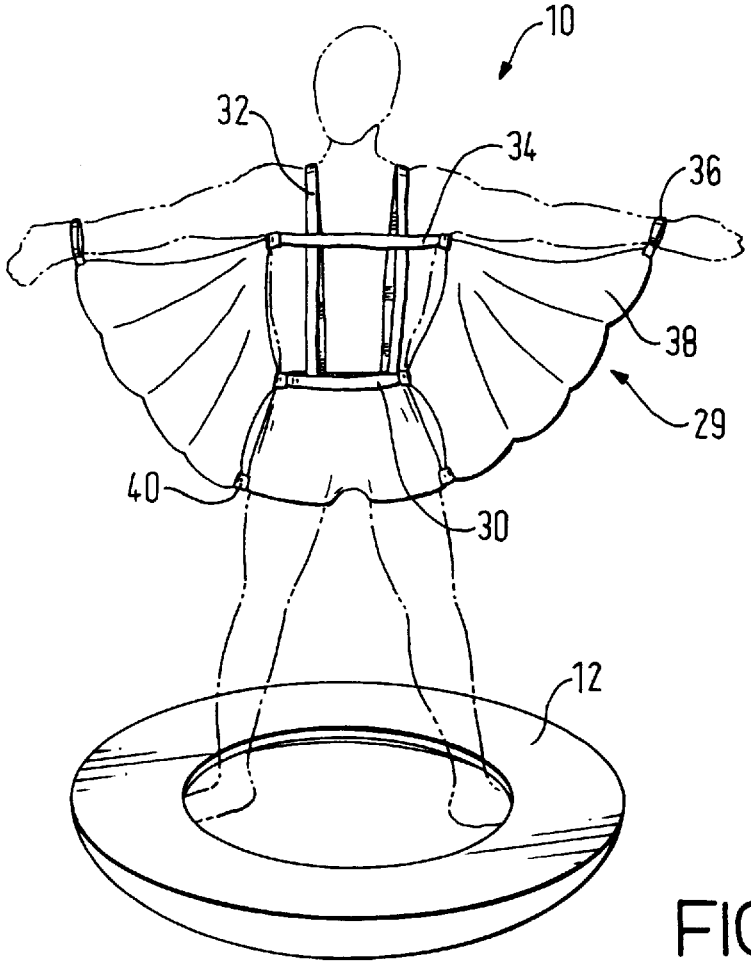
FIG. 1 is a perspective view of a first embodiment of a new wind propelled watercraft according to the present invention.
Figure 2:
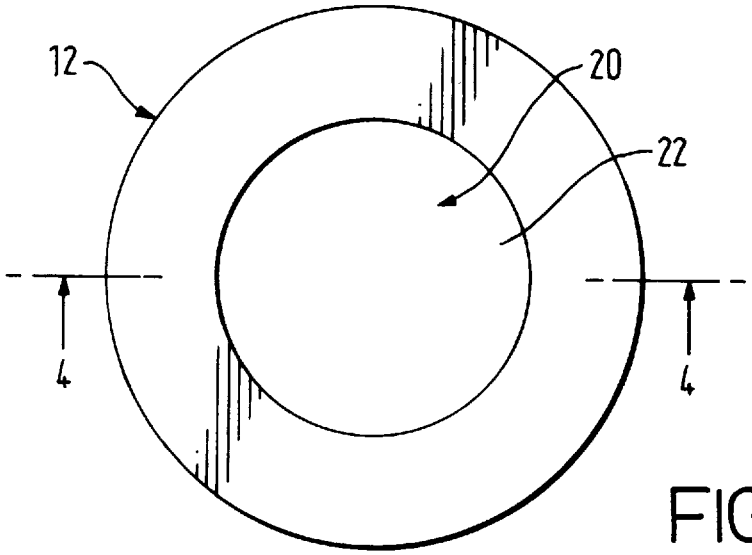
FIG. 2 is a top view of the base of the watercraft of FIG. 1.

With reference now to the drawings, and in particular to FIGS. 1 through 4 thereof, a new wind propelled watercraft embodying the principles and concepts of the present invention and generally designated by the reference numeral 10 will be described.

Figure 3:
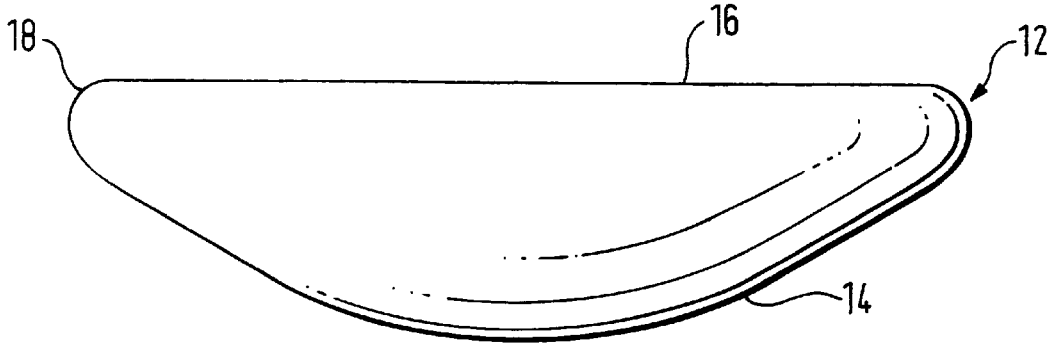
FIG. 3 is a side view of the base of the watercraft of FIG. 1.
Figure 4:
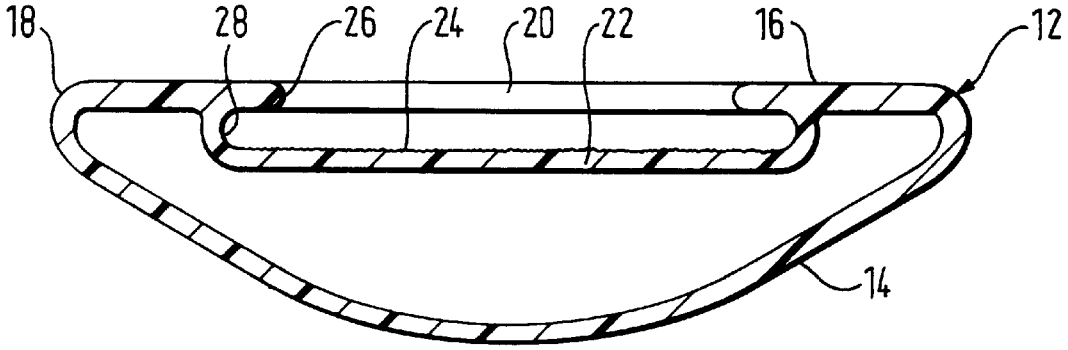
FIG. 4 is a side cross-sectional view of the base of the watercraft of FIG. 1 taken along line 4—4 shown in FIG. 2.

The wind powered watercraft designated as numeral 10 includes a floating disk 12 forming a base and having a bulbous bottom face 14 with a generally part-spherical configuration at least over its central portion. As shown in FIGS. 3 and 4, in this first embodiment the bottom face is more rounded at a central extent thereof and tapers in more of a horizontal or straight-line fashion toward a periphery thereof. A top face 16 of the floating disk has a generally planar circular configuration. As shown in FIG. 4, the top face and bottom face of the base are coupled along a periphery thereof for defining a hollow interior. When coupled, the periphery of the top face and bottom face define an easily handled annular grip region 18. The floating disk may be constructed from fibreglass or any other suitable buoyant material.

As shown in the various Figures, the top face of the base 16 has a recess 20 formed in concentric relationship therewith. The recess includes a bottom plate 22 with a planar circular configuration and an upper roughened i.e. slip-resistant surface 24. The diameter of the bottom plate 22 of the recess 20 is approximately half that of the floating disk.

The top face of the disk 12 further has an annular flange 26 integrally coupled to an upper peripheral edge of the recess 20. As shown in FIG. 4, such annular flange extends radially inwardly from the upper peripheral edge of the recess in coplanar relationship with the top face of the disk. The annular flange is spaced from the bottom plate of the recess thereby defining an annular groove 28. In operation, a user is supported by the disk in a body of water. For stabilization purposes, the user may insert his or her toes within the annular groove, as seen in FIG. 1.

Next provided is a sail assembly 29 including a waist strap 30. Also included is a pair of vertically oriented parallel shoulder straps 32 each having a bottom end coupled to the waist strap. A torso strap 34 is coupled to upper portions of the shoulder straps in parallel with the waist strap. As shown in FIG. 1, a pair of wrist straps 36 are also included. It should be noted that the waist and torso straps are each removably coupled in a closed loop configuration at a side portion thereof.

The sail assembly further includes a pair of nylon sails 38 each having a generally triangular configuration with an arcuate outer edge. With reference still to FIG. 1, each sail is equipped with a linear top edge having an outboard end coupled to one of the wrist straps 36. A linear inner edge of each sail has a top end coupled to the torso strap 34 and a central portion coupled to the waist strap 30. As shown in FIG. 1, the waist strap is preferably a component of a pair of trunks. Ideally, a bottom end of the inner edge of each sail is further connected to a lower portion of the trunks prior to use as shown at 40. In an alternate embodiment, the sails may simply be attached to a conventional full-body swimming suit (wet-suit). By this structure, the user may o be propelled about on the body of water by way of wind. During use, the user acts as a mast of the watercraft. Maneuverability may be achieved by simply varying the orientation of the sails by the user moving their arms.

The watercraft illustrated in FIGS. 1 to 4 has a number of advantages which make it a practical craft compared with the prior art. The sail is of manageable size, and is not out of proportion to the ability of the user to control it in a still wind. If the user does get into difficulties, they can very easily drop their hands to their sides and immediately the force on them from the sails is virtually eliminated, allowing them to recover their stability. If even then they are uncertain, they can simply sit down on the disk 12 and await rescue in comparative safety.

That is to say the linear top edge of the sail is capable of being attached to the user's arm to be held alongside the user's arm and the linear inner edge of the sail is capable of being attached to the user's body to be held alongside the user's body. The sails can thereby be moved between an extended position by the user extending their arms away from the body as shown, in which extended position the user provides the sole support for the sails while the sails fill with wind, and a collapsed position by the user placing their arms by the side of their body, in which collapsed position the sails spill the wind.

When the arms are up and the sails are full of wind, the pressure from the wind is applied to the user's body at a plurality of points, thus being distributed between the arms, torso, and hips. This makes it easier for the user to stand against the wind and allow the craft to move with the wind. The sail is almost an integral part of the body and is spread between the arms and body in a relatively natural way.

As is seen from the foregoing, the new watercraft has no need for a mast or other structure for supporting the sails. The user provides the sole support for the sails. The mast is replaced by the human body which stands inside the disk and holds the disk firmly by feet or toes inserted into the foot grips provided by the groove 20 on the disk. The wind energy is transferred from the sails directly to the body, and then from the body to the floating disk, thus propelling the disk. The circular nature of the floating disk makes it possible for the body to stand on it and balance itself easily even when the disk is in a static position. The foot or toe grip provides a further means by which the body is firmly attached to the disk when the craft is moving. At the same time the body is free to move in any direction, both horizontally and vertically, manipulating the sails according to the nature of the wind and thus making the disk move in a desired direction. The human body, the sails and the disk thus form an integral sailing system, in which there is no separation between the sailing craft and the sailor.

As to a further discussion of the manner of usage and operation of the present watercraft, the same should be apparent from the above description. Accordingly, no further discussion relating to the manner of usage and operation will be provided.

Various modifications may be made to the arrangement illustrated. More specifically, the wrist straps 36 could be replaced by a handle in the fabric of the sail or by a simple length of cord that is held by the user, rather than being permanently attachable to the user's wrist. This allows the user to release the sail completely when required, for example when returning to a support craft or the like. Another modification is that the attachment point 40 to the bottom of the trunks could be replaced by a thigh strap which passes round the users thighs, thus avoiding the need to wear special trunks, which may not be attractive to all users. The sails and the swimsuit can be constructed as a composite article.

A second wind powered watercraft embodying the invention will now be described with reference to FIG. 5 of the drawings, which is a side view of the watercraft with the user thereon and showing the base in section.

The second wind powered watercraft 50 has a floating base 52 which is generally disk-shaped in plan. The base 52 has a convex bottom face 54 which is part-spherical over substantially all of its extent except for the peripheral portion thereof where it bends more sharply to meet smoothly with a top face 56 of the floating disk. The periphery of the disk where the top and bottom faces join forms an annular grippable portion 58 by which a user may easily transport the disk.

In this embodiment the base is solid rather than hollow and is constructed from solid polystyrene (Styrofoam) covered with a suitable hard plastic material. Such type of construction is well-known for making surfboards and the like and need not be further described.

The top face 56 of the circular base 52 has provided on it a circular rigid substantially L-section ring 60 arranged so as to form an inwardly-facing groove 68 concentrically on the base. The diameter of the ring 60 is approximately half that of the base 52. The size of the groove 68 is, as with the first embodiment, such that the user may conveniently insert their foot or toes to give them greater stability on the base. The groove is fixedly open and thus easily accessible to the user's foot as they move on the disk. That portion of the top face 56 of the disk which is within the ring 60 is rendered non-slip by being roughened or by having a thin sheet of rubber matting adhered to it.

Considering the use of the base, the curved bottom face 54 allows balance and flexibility. Because of its continuously curved, and indeed part-spherical, shape over its greater part, it is equally happy to sit at any angle in the water over a wide range of angles. This lends the disk improved balance and flexibility. Some departure from a strictly part-spherical shape may achieve much the same result, but in any event the bottom face should be smoothly continuously curved, rather than triangular in section so as to avoid having two stable portions with a relatively unstable region between them. The composition of the material forming the base may be non-uniform or the base may be weighted, to assist the stability of the base.

The shape of the base 12 of the first embodiment of FIGS. 1 to 4 may desirably be part-spherical similar to the base 52 of the second embodiment.

Figure 5:
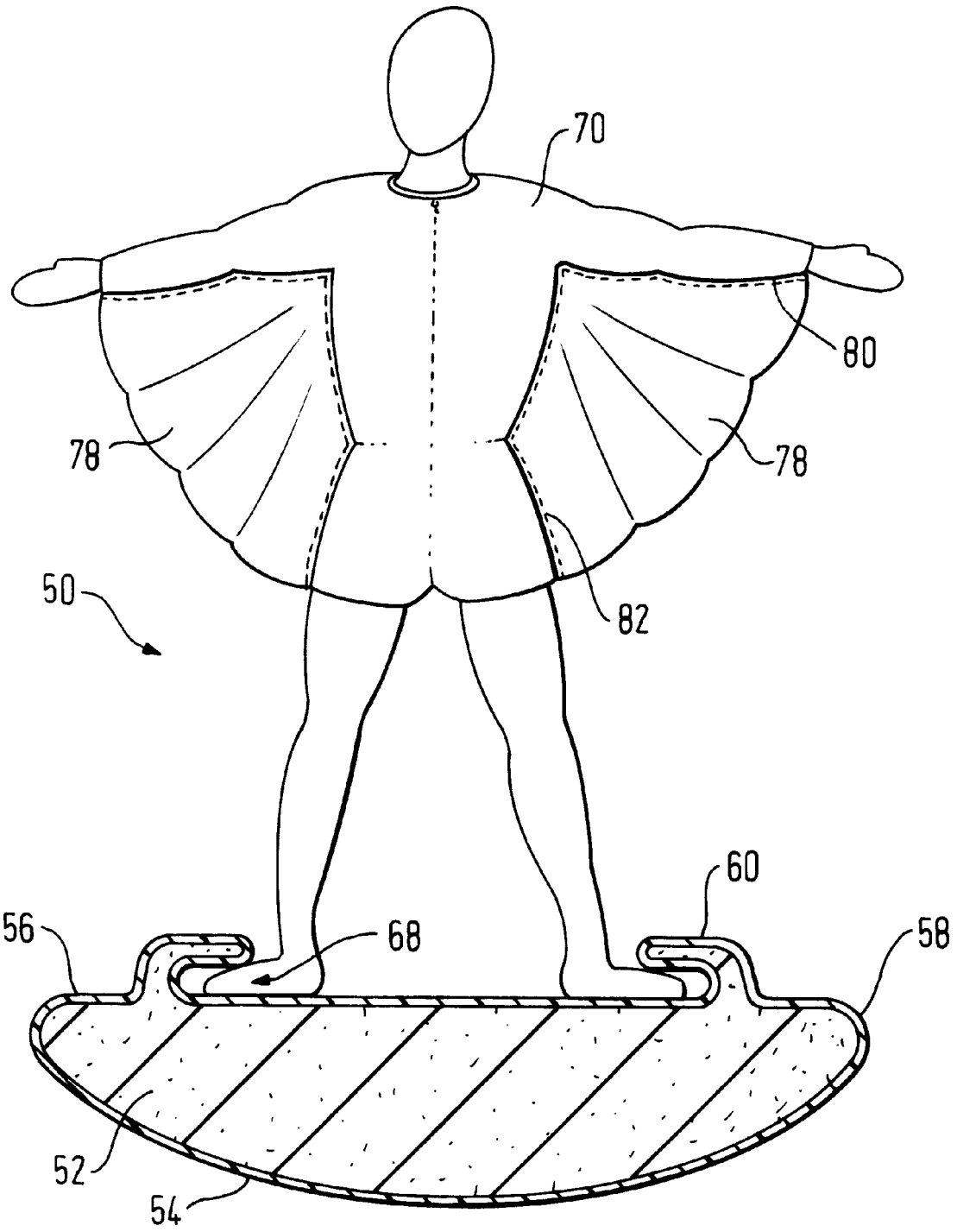
FIG. 5 is a side view of a second embodiment of a wind propelled watercraft in accordance with the invention, with the base of the watercraft shown in section.
Figure 6:
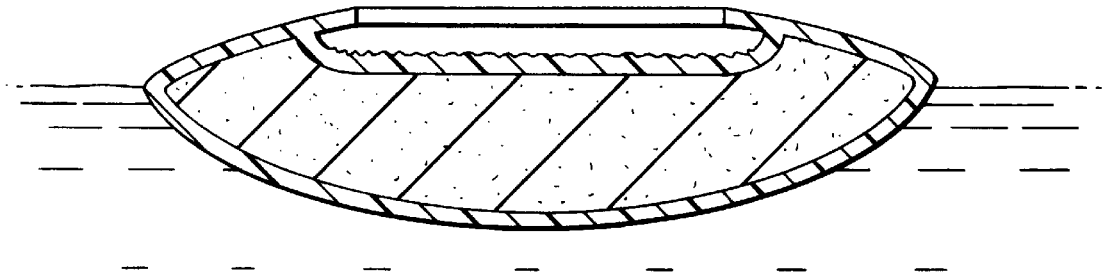
FIG. 6 illustrates a first modified base shape.

The shape of the base may be modified as shown in FIG. 6 to have a convex rather than flat upper surface, with the toe-receiving groove either below that surface, as shown in FIG. 6, or above the top surface, similarly to FIG. 5.

Reverting to FIG. 5, in the second embodiment the user wears a neoprene wet suit 70 which is provided with attachment points for the pair of sails. The sails 78 are again of nylon and each are of generally triangular shape. The top edge 80 of each sail is substantially continuously attached to the arms of the wet suit by means of a suitable elongate fastening. The fastening may consist of a zipper, a hook-and-loop type fastening (e.g. Velcro™), or a series of hooks and eyes. Likewise the inner edge 82 of each sail is substantially continuously attached to the body and upper leg portion of the wet suit by similar fastenings.

The watercraft of the second embodiment is used in similar manner to the first embodiment. As with the first embodiment, the user has a high degree of control due to the ability to drop the arms and spill the wind out of the sails, completely or partially.

Figure 7:
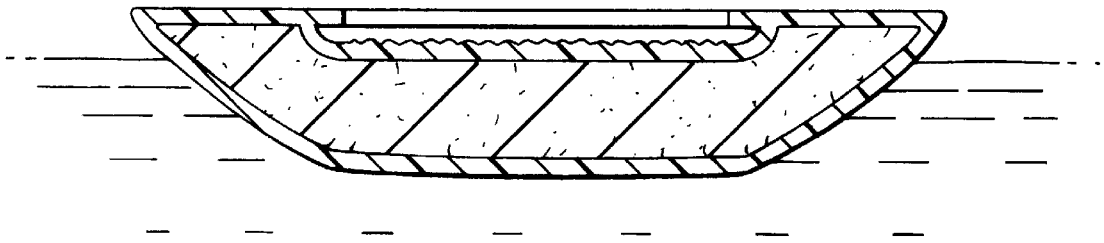
FIG. 7 illustrates a second modified base shape.

Another modified base shape is illustrated in FIG. 7. Here the base shape is bowl-shaped with the bottom face thereof having a less-curved central region, more-curved annular portion, and less-curved peripheral region.

With respect to the above description, it is to be realized that the optimum dimensional relationships for the parts of the watercraft, to include variations in size, materials, shape, form, function and manner of operation, assembly and use, are deemed readily apparent to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

For example, the material of which the base is made could alternatively comprise wood, rubber, other plastics, or metal, instead of fibreglass or covered polystyrene, or could be formed of combinations of these.

It should be noted that the features of the two embodiments may be used in combinations other than those shown and particularly described.

I claim:

1. A wind propelled watercraft system comprising, in combination:

a floating disk including a bottom face and a top face with a generally planar circular configuration coupled to the bottom face for defining a hollow interior, the top face having a recess formed in concentric relationship therewith and including a bottom plate with a planar circular configuration and an upper slip-resistant surface, the top face further having an annular flange integrally coupled to an upper peripheral edge of the recess and extending radially inwardly therefrom in coplanar relationship with the top face of the disk and spaced from the bottom plate of the recess thereby defining an annular groove for receiving toes of a user; and a sail assembly including a waist strap, a pair of vertically oriented parallel shoulder straps each having a bottom end coupled to the waist strap, a torso strap coupled to upper portions of the shoulder straps in parallel with the waist strap, and a pair of wrist straps, the sail assembly further including a pair of sails each having a generally triangular configuration with a linear top edge having an outboard end coupled to one of the wrist straps, and a linear inner edge having a top end coupled to the torso strap and a central portion coupled to the waist strap.

2. A wind propelled watercraft system comprising:

a floating disk including a curved bottom face and a top face with a generally planar circular configuration coupled to the top face to provide a grippable annular periphery, the top face being provided with a recess formed in concentric relationship therewith and including a bottom plate with a plane circular configuration and an upper slip-resistant surface, the top face further having an annular flange integrally coupled to an upper peripheral edge of the recess and extending radially inwardly therefrom in coplanar relationship with the top face of the disk and spaced from the bottom plate of the recess thereby defining an annular groove for receiving the toes of a user; and a sail assembly for driving the user on the floating disk by way of wind.

3. A wind propelled watercraft system as set forth in claim 2 wherein the sail assembly includes a pair of sails to be worn by the user.

4. A wind propelled watercraft system as set forth in claim 2 wherein the sail assembly includes a pair of sails attached to arms and torso of a body of the user.

5. A wind propelled watercraft system as set forth in claim 3 wherein the sails are secured to the user by way of a plurality of straps.

6. A wind propelled watercraft system comprising, in combination:

floating means for supporting a user on a body of water; and a sail assembly including a waist strap, a pair of vertically oriented parallel shoulder straps each having a bottom end coupled to the waist strap, a torso strap coupled to upper portions of the shoulder straps in parallel with the waist strap, and a pair of wrist straps, the sail assembly further including a pair of sails each having a generally triangular configuration with a linear top edge having an outboard end coupled to one of the wrist straps, and a linear inner edge having a top end coupled to the torso strap and a central portion coupled to the waist strap, wherein the sails are attached at a bottom end thereof to a bottom periphery of a pair of trunks.

7. A wind propelled watercraft system as set forth in claim 6 wherein the floating means includes a disk.

8. A wind propelled watercraft system as set forth in claim 6 wherein the floating means has means for securing to feet of a user.

9. A wind propelled watercraft system as set forth in claim 8 wherein the means for securing to feet of a user includes a fixedly-open annular groove.

10. A wind propelled watercraft system as set forth in claim 8 wherein the means for securing to feet of a user includes a recess with a roughened upper surface.

11. A wind propelled watercraft system as set forth in claim 6 wherein the floating means includes a disk with a bulbous bottom face.

12. A wind propelled watercraft system comprising:

a floating disk of generally circular configuration with a bottom face of generally continuously-curved configuration coupled at its periphery to a top face to provide a grippable annular periphery to the disk, the top face being provided with means defining an inwardly-facing fixed groove for receiving the toes of a user and a slip-resistant surface being formed inwardly of the groove; and a sail assembly for driving the user on the floating disk by way of wind, the said assembly comprising a pair of generally triangular sails each having a top linear edge, an inner linear edge, and an outer periphery, the top linear edge being provided with first attachment means whereby in use the top linear edge is held alongside the user's arm, and the inner linear edge being provided with second attachment means whereby in use the inner linear edge is held alongside the user's body, and wherein the sails can be moved between an extended position by the user extending their arms whereat the user provides the sole support for the sails and the sails can fill with wind, and a collapsed position by the user placing their arms by the side of their body whereat the sails spill the wind.

13. A wind propelled watercraft system as set forth in claim 12 wherein the bottom face of the floating disk is generally part-spherical.

14. A wind propelled watercraft system as set forth in claim 12 wherein the sails are secured to the user by way of a plurality of straps.

15. A wind propelled watercraft system as set forth in claim 12 wherein the sails are secured to the user by being attached by the first and second attachment means to a suit worn by the user.

16. A wind propelled watercraft system as set forth in claim 15 wherein the first and second attachment means are substantially-continuous attachment means.

* * * * *